US006821079B2

(12) United States Patent
Priebe et al.

(10) Patent No.: US 6,821,079 B2
(45) Date of Patent: Nov. 23, 2004

(54) PILL AND CAPSULE COUNTER

(75) Inventors: Robert N. Priebe, Bloomington, MN (US); Terrance O. Noble, Burnsville, MN (US)

(73) Assignee: Apothecary Products, Inc., Burnsville, MN (US)

( * ) Notice: Subject to any disclaimer, the term of this patent is extended or adjusted under 35 U.S.C. 154(b) by 81 days.

(21) Appl. No.: 10/086,976

(22) Filed: Mar. 1, 2002

(65) Prior Publication Data

US 2003/0165377 A1 Sep. 4, 2003

(51) Int. Cl.[7] ..... G06M 3/00
(52) U.S. Cl. ..... 414/675; 414/901
(58) Field of Search ..... 414/675, 901; 221/7, 13, 93, 264

(56) References Cited

U.S. PATENT DOCUMENTS 2,623,647 A * 12/1952 Erickson ..... 414/675
2,863,572 A * 12/1958 Bethard et al. ..... 414/675
3,662,904 A * 5/1972 Tune ..... 414/675
4,018,358 A 4/1977 Johnson et al.
4,047,620 A 9/1977 Deininger
4,597,091 A 6/1986 Blake
6,196,426 B1 3/2001 White

OTHER PUBLICATIONS

"Apothecary Products, Inc., " "The Ultimate Pharmacy Buyer's Guide to Drug Specialities" pp 288–293 (Sep. 2001).
"Spin–Count™ Pill and Capsule Counter," Apothecary Products, Inc., 2 pages (1996).
"Instructions For Use Of The Shake & Roll Speedee Tablet/Capsule Counter,"™ Apothecary Products, Inc., 3 pages, date unknown.

* cited by examiner

*Primary Examiner*—Donald W. Underwood
(74) *Attorney, Agent, or Firm*—Merchant & Gould P.C.

(57) ABSTRACT

A device for rapidly counting and dispensing pills and capsules is provided. A movable plate with apertures and sizing guide fit inside a housing. The sizing guide has apertures corresponding to a particular size of pill or capsule, allowing the desired number of pills or capsules to be counted in a first section of the housing. When the excess pills or capsules are removed, the counted pills or capsules are transferred to a second section of the housing for dispensing into a prescription bottle by moving the plate and placing its apertures in register with the sizing guide apertures.

14 Claims, 7 Drawing Sheets

PILL AND CAPSULE COUNTER

BACKGROUND OF THE INVENTION

The invention relates to an apparatus for counting pills and capsules of different sizes. Various devices for counting pills have been made, ranging from a simple tray with a pouring spout to large devices for automatically counting hundreds or thousands of pills. The simple trays provide rapid dispensing of the counted pills, but require manual counting. The automatic counting devices eliminate the need for manual counting, but are generally not practical for counting a small number of pills, and are often difficult to clean.

SUMMARY OF THE INVENTION

The invention provides an automatic counting device that allows for rapid counting and dispensing of either pills or capsules, allows for simple return of excess pills or capsules to the stock bottle, and is easily cleaned. The counting device includes a housing, a movable plate and a removable sizing guide. The housing has an opening for delivering the counted pills to a prescription bottle. The housing may additionally have a second opening for returning excess pills to a stock bottle. The movable plate divides the housing into an upper section where the pills are counted, and a lower section for transferring the counted pills to a prescription bottle. The removable sizing guide fits over the movable plate and has apertures that align with apertures in the movable plate when the movable plate is moved to a second position, allowing counted pills or capsules to pass through to the lower section of the housing.

DETAILED DESCRIPTION OF THE PREFERRED EMBODIMENT

Figure 1:
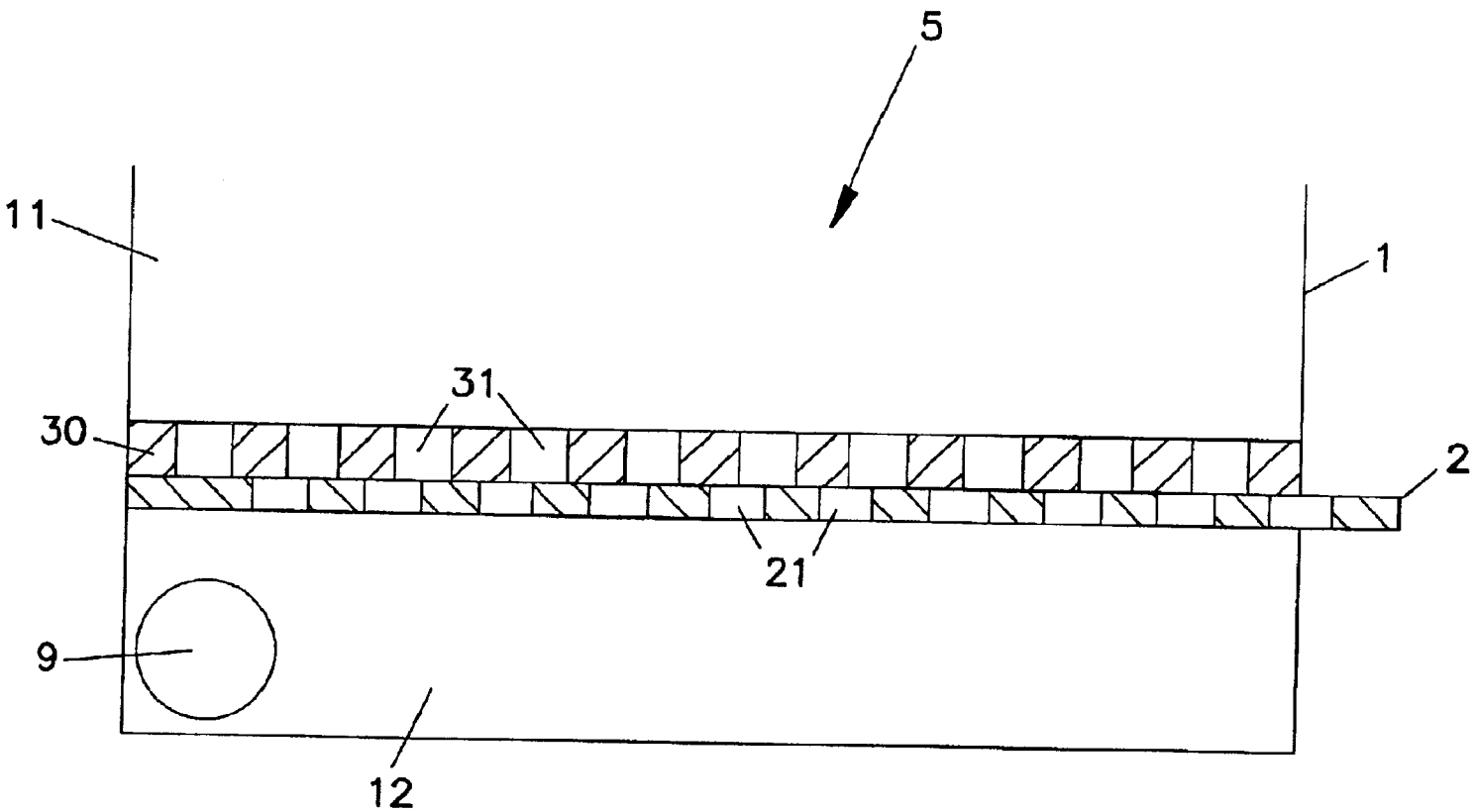
FIG. 1 is a side view of a pill counter according to the invention.

Corresponding reference numbers indicate corresponding parts throughout the several views in the drawings. One embodiment of a pill counter according to the invention is shown in FIG. 1. The pill counter 5 includes a housing 1 having at least one chamber, a moveable plate 2 and one or more removable sizing guides 30. The housing 1 is divided into an upper section 11 and a lower section 12 by the moveable plate 2. The housing 1 is shown as having a rectangular or square shape. The housing 1 can be of any shape including a polygon, circle, ellipse, etc. The housing 1 has an opening 9 in the lower section 12 for dispensing the counted pills or capsules. The moveable plate 2 is moveable from a first position to a second position. The plate 2 can move laterally or it can pivot about a fixed point. The plate 2 is supported by grooves, rails, channels, ridges, or any other protrusions or recesses in walls of the housing 1.

The sizing guide 30 fits within the chamber and is substantially aligned with and vertically displaced from the movable plate 2. The sizing guide 30 and the moveable plate 2 have a plurality of apertures, 31, 21, respectively. The apertures 31, 21 are sized to allow pills or capsules to pass through. The apertures 31 in the sizing guide 30 are arranged in a pattern that is the same as the pattern of apertures 21 in the plate 2. The pattern of apertures 31, 21 can be one of columns and rows, with the number of apertures 31, 21 in each column and/or row being a fraction of often-desired numbers of pills. For example, a pattern of 100 apertures 31, 21 in rows and 5 apertures 31, 21 in columns provides the ability of counting up to 50 pills or capsules in increments of 5.

The apertures 31 in the sizing guide 30 can be numbered for easy reference. Alternatively, the walls of the housing 1 can be labeled with numbers corresponding to the total number of apertures in one column and counting across the columns of apertures 31 in the sizing guide 30. In the above example, the housing wall adjacent the first column of apertures 31 would be labeled "5", the next column would be labeled "10" and so on down up to "50" for the last column. In one embodiment, the sizing guide 30 is removably inserted into the upper section 11 of the housing 1 and rests on the plate 2, as shown in FIG. 1. In another embodiment, the removable sizing guide 30 can be supported by the grooves, rails, channels, ridges, or any other protrusions or recesses in walls of the housing 1, with the plate 2 resting on top of the sizing guide 30.

When the plate 2 is in the first position, the apertures 21 in the plate 2 and the apertures 31 in the sizing guide 30 are offset and out of register. When the plate 2 is moved into the second position, the apertures 21, 31 move into register. As used herein, "register" is intended to mean a condition of correct alignment or proper relative position. The range of movement of the plate 2 is dependent on the spacing between the apertures 31, 21 in the sizing guide 30 and plate 2. There is space between the apertures 21 in the plate 2 for pills that have settled into apertures 31 in the sizing guide 30 to rest on the plate 2 between apertures 21. Having the counted pills settle into the apertures 31 in the sizing guide 30 without immediately falling through to the lower section 12 of the housing 1 allows for the excess pills to be removed, and assures that only one pill goes through each set of apertures 31, 21 for accurate counting.

In one embodiment, the plate 2 extends beyond at least one wall of the housing 1. The extended portion is used to move the plate 2 from the first position to the second position. The moveable plate 2 shown in FIG. 1 extends between opposite sides of the housing and protrudes from one end when in the first position. The moveable plate 2 need not extend all the way between sides of the housing 1. The combined surfaces of the sizing guide 30 and plate 2, when in the first position, extend across the housing such that pills or capsules placed into the upper section 11 of the housing 1 do not fall into the lower section 12.

In use, the apertures 31 corresponding to the desired number of pills or capsules are separated from the remaining apertures 31 using, for example, a divider, spatula, the user's hand, or any other tool. An excess of pills or capsules to be counted is placed into the upper section 11 of the housing 1. The pill counter 5 is tilted or shaken to allow the pills or capsules to settle into the apertures in the sizing guide 30.

Since the apertures 31, 21 in the sizing guide 30 and in the plate 2 are out of register, the pills or capsules rest on the plate 2. The excess pills or capsules are removed, and the plate 2 is moved into the second position, moving the apertures 31, 21 into register and allowing the counted pills to fall through to the lower section 12 of the housing 1. The pill counter 5 is then manipulated to dispense the counted pills through the opening 9 in the housing 1 into a bottle or other vessel.

In an alternative embodiment, counted pills can be dispensed from a housing without an opening 9 by removing the sizing guide 31 and retracting the plate 2 to allow access to the lower section 12 of the housing 1.

Figure 2:
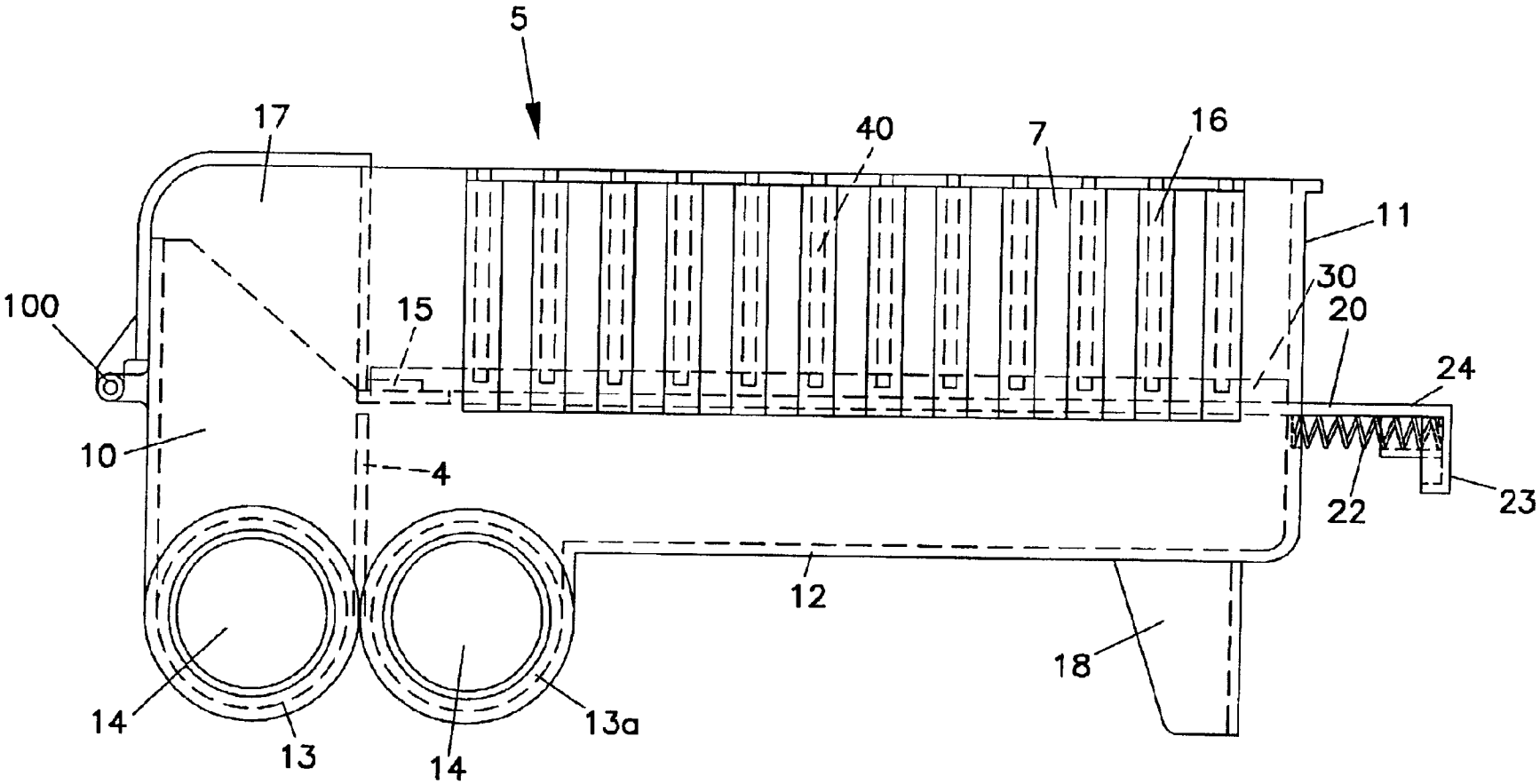
FIG. 2 is a side view of another embodiment of a pill counter according to the invention.

Another embodiment of the invention is shown in FIGS. 2–7. As shown in FIG. 2, the pill counter 5 includes a housing 10, a movable plate 20, a removable sizing guide 30 and a divider 40. The housing 10 has at least one chamber that is divided into an upper section 11 and a lower section 12 by the movable plate 20. In a further embodiment, the housing 10 can include one or more troughs 13, 13*a* for dispensing pills into either a stock bottle or a prescription bottle. The troughs 13, 13*a* can have openings 14 to facilitate dispensing pills into bottles. Alternatively, the lower section 12 of the housing 10 can have one or more openings for dispensing the pills.

When two troughs 13, 13*a* are present, they can be separated by a wall 4. Trough 13 serves to return excess pills to a stock bottle, and trough 13*a* allows for dispensing the counted pills into a prescription bottle or other container. In an alternate embodiment, wall 4 can separate regions of the lower section 12 of the housing 10. Each region would preferably have an opening for dispensing pills.

Figure 3:
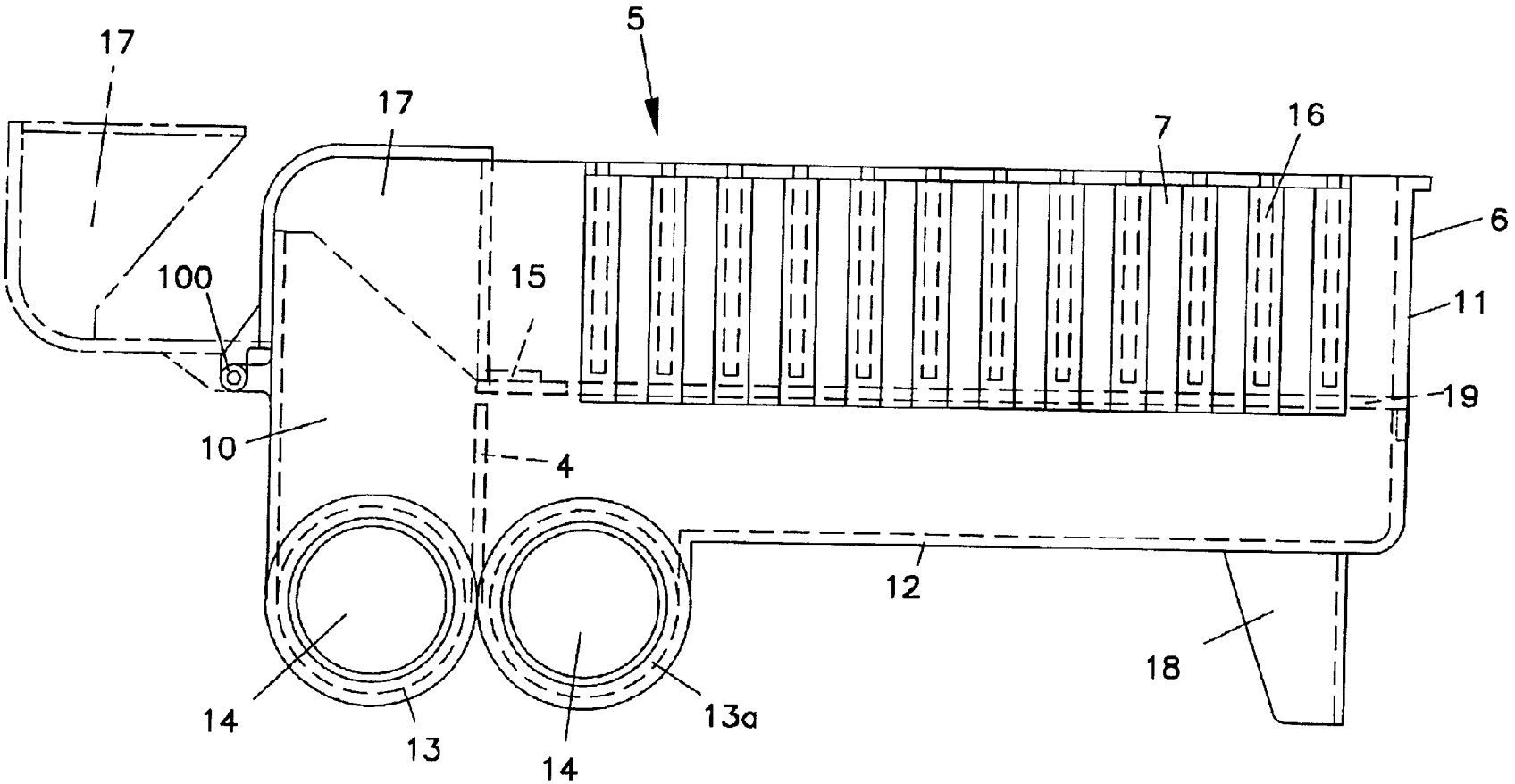
FIG. 3 is a side view of a housing according to the invention, showing a movable barrier in both the closed and open position.

In a still further embodiment, an optional movable barrier, such as the pivoting cover 17 shown in FIGS. 2 and 3, is positioned such that in a closed position (FIG. 2) it forms a wall between trough 13 and the upper section 11 of the housing. In one embodiment, the pivoting cover 17 moves between an open and a closed position via a hinge 100. In FIG. 3, the pivoting cover 17 is shown in the closed position (solid lines) and in the open position (dashed lines). The pivoting cover 17 is closed when pills or capsules are poured into the upper section 11 of the chamber for counting. The cover 17 prevents the pills or capsules from falling into the trough 13. Once the pills to be counted are in place in the sizing guide apertures 31, the pivoting cover 17 is opened and the excess pills or capsules can be transferred from the upper section 11 of the chamber to the trough 13 for return to a stock bottle. In another embodiment, a divider or other barrier can be used to prevent pills from falling into trough 13 when an excess of pills is poured into the upper section 11 of the housing for counting.

If present, the troughs 13, 13*a* can support one end of the housing. The housing can additionally have one or more legs 18 on the end opposite the troughs 13, 13*a*, as shown in FIG. 2. Alternatively, the troughs 13, 13*a* can be spaced apart to support the pill counter 5.

Housing side walls 7, 8, can have grooves, rails, channels, ridges or any other type of recesses or protrusions to support the movable plate 20. In the embodiment shown in FIG. 3, an opening 19 in one wall of the housing 10 receives the movable plate 20 (see FIG. 2). The opening 19 can be in any wall of the housing. Alternatively, the plate 20 may not extend beyond the outer walls of the housing 10. In such an embodiment, an additional structure extending beyond the housing walls could be attached to the plate 20 to move the plate 20 between first and second positions. In the embodiment of FIG. 2, when the plate 20 is inserted into the housing 10, the plate 20 can extend from the rear wall 6 of the housing to a short wall 4 separating the two troughs 13, 13*a*. Alternatively, the plate 20 could extend less than this distance, with the sizing guide 30 covering the remaining part of the lower section 12 of the housing. In order for the pills to be counted accurately, the combination of the removable sizing guide 30 and the plate 20, when in the first position, should cover the lower section 12 of the housing 10 to prevent pills from falling into the lower section 12 of the housing 10. In the embodiment shown in FIG. 2, wall 4 extends up between the troughs 13, 13*a* and ends beneath the movable plate 20, enclosing the lower section 12 of the housing.

Figure 4:
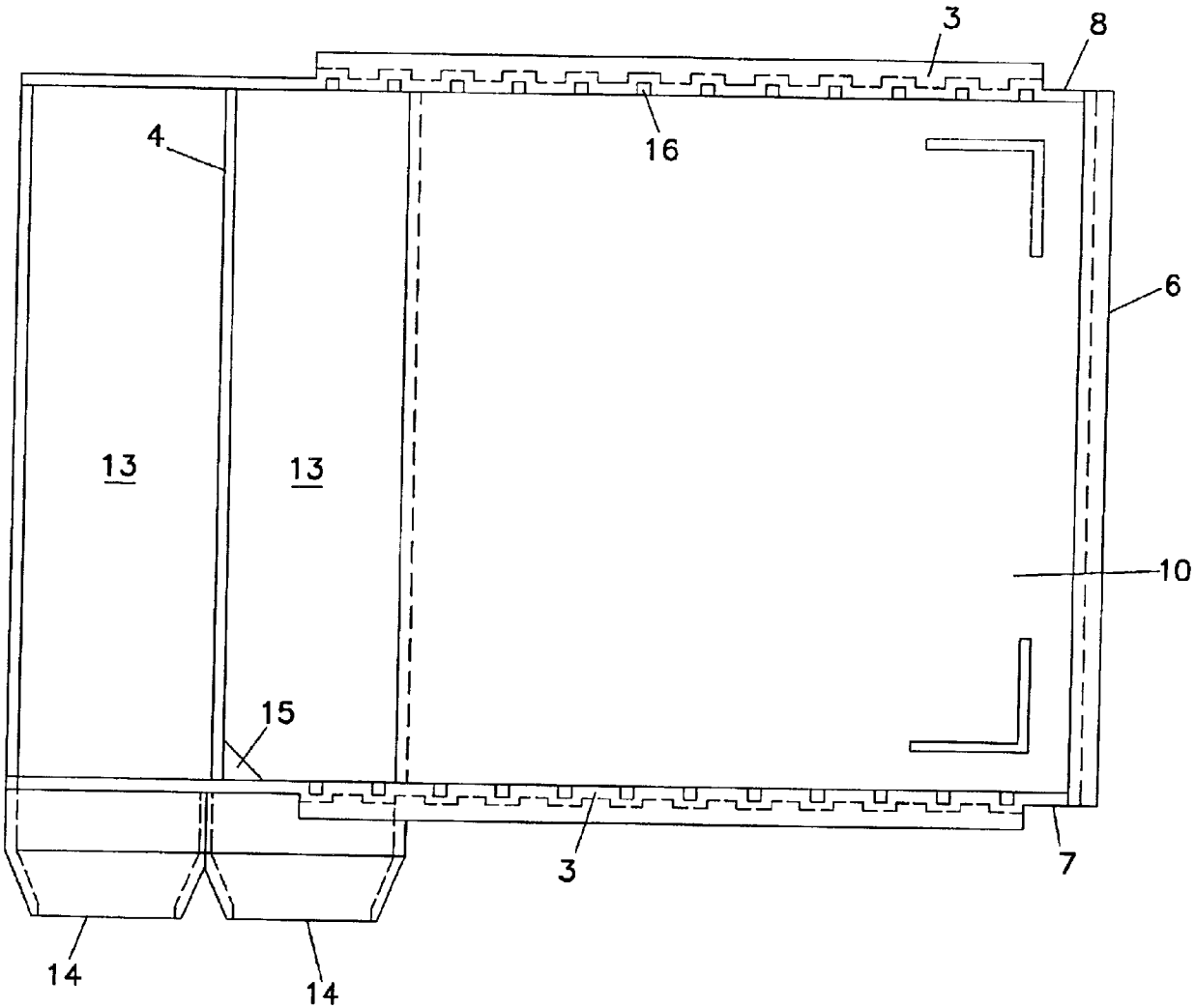
FIG. 4 is a top view of the housing of FIG. 3.

In the embodiment shown in FIG. 4, the housing 10 has slots 16 in the side walls 7, 8 for placement of a divider 40 to separate a section of the sizing guide corresponding to the desired number of pills or capsules to be counted. Alternatively a divider or other barrier could be held in place by the user. In one embodiment, the housing walls 7, 8 have flanges 3 at their upper edges. The flanges 3 can be labeled with the number of pills corresponding to each slot 16. The housing can have a marker 15 for aligning the sizing guides. In the embodiment shown in FIG. 4, the marker 15 is a triangular protrusion positioned above the recesses for the movable plate 20. The marker 15 matches a notched corner 32 on the sizing guides 30 for correct placement of the sizing guides in the housing.

The movable plate 20 has apertures 21 sized to allow the counted pills or capsules to fall through into the lower section 12 of the housing 10. In one embodiment, the apertures 21 are at least as large as the largest size of pills and/or the diameter of the largest capsules that would be counted using the device. See FIG. 5. In another embodiment, multiple movable plates 20 could be provided, each with a different size of apertures 21 corresponding to a particular sized pill and/or capsule. In one embodiment, the apertures 21 are arranged in offset rows and columns to maximize the number of apertures 21 for the size of the plate. The number of apertures 21 in each column corresponds with a number of pills often desired, such as 5 or 10. With this type of arrangement, pills or capsules in multiples of 5 or 10 can easily and rapidly be counted and dispensed.

In one embodiment, the movable plate 20 has a region 24 that extends beyond the housing 10 when the plate 20 is inserted into the housing 10. Alternatively, the entire length or width of the plate could extend beyond the housing. In a still further embodiment, the plate 20 can be sized to fit within the walls of the housing, and a separate and/or attachable mechanism can be used to move the plate between first and second positions. In the embodiment illustrated in FIGS. 2 and 5, the extended region 24 has a flange 23 for moving the plate 20 from a first position to a second, inserted position.

Figure 5:
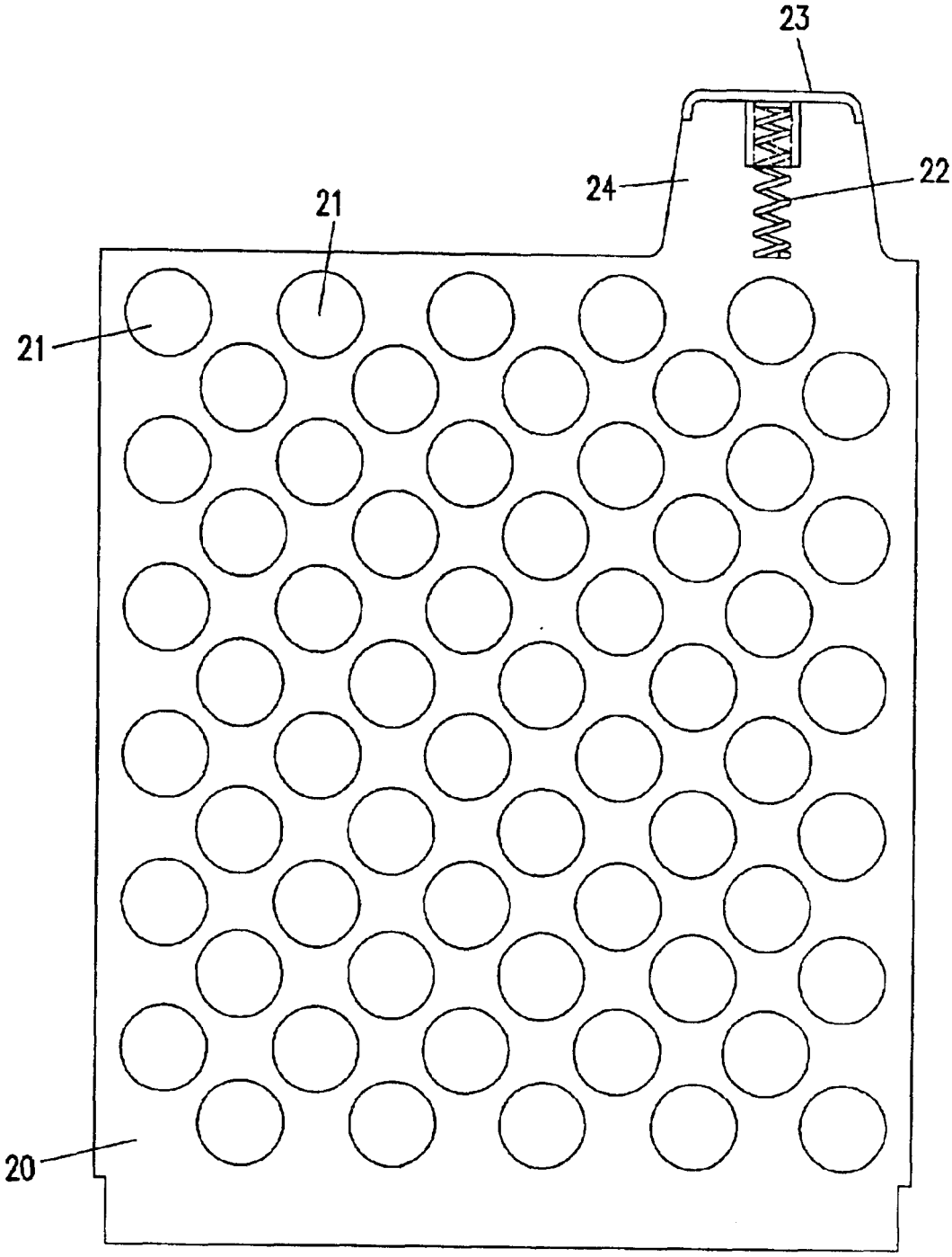
FIG. 5 is a bottom view of a movable plate according to the invention.

The plate 20 can be moved from the first position to the second position manually. Alternatively, a spring 22 attached to the flange 23, as shown in FIGS. 2 and 5, can be used to automatically return the plate 20 to the first position after manually moving the plate into the second position. The spring 22 rests against the rear wall 6 of the housing when the plate is in the first position. When pressure is exerted on the flange 23 of the plate 20, the spring 22 compresses, causing the plate 20 to be inserted into the housing, moving the plate into the second position. When pressure is released, the spring 22 releases, allowing the plate 20 to return to the first position.

Figure 6:
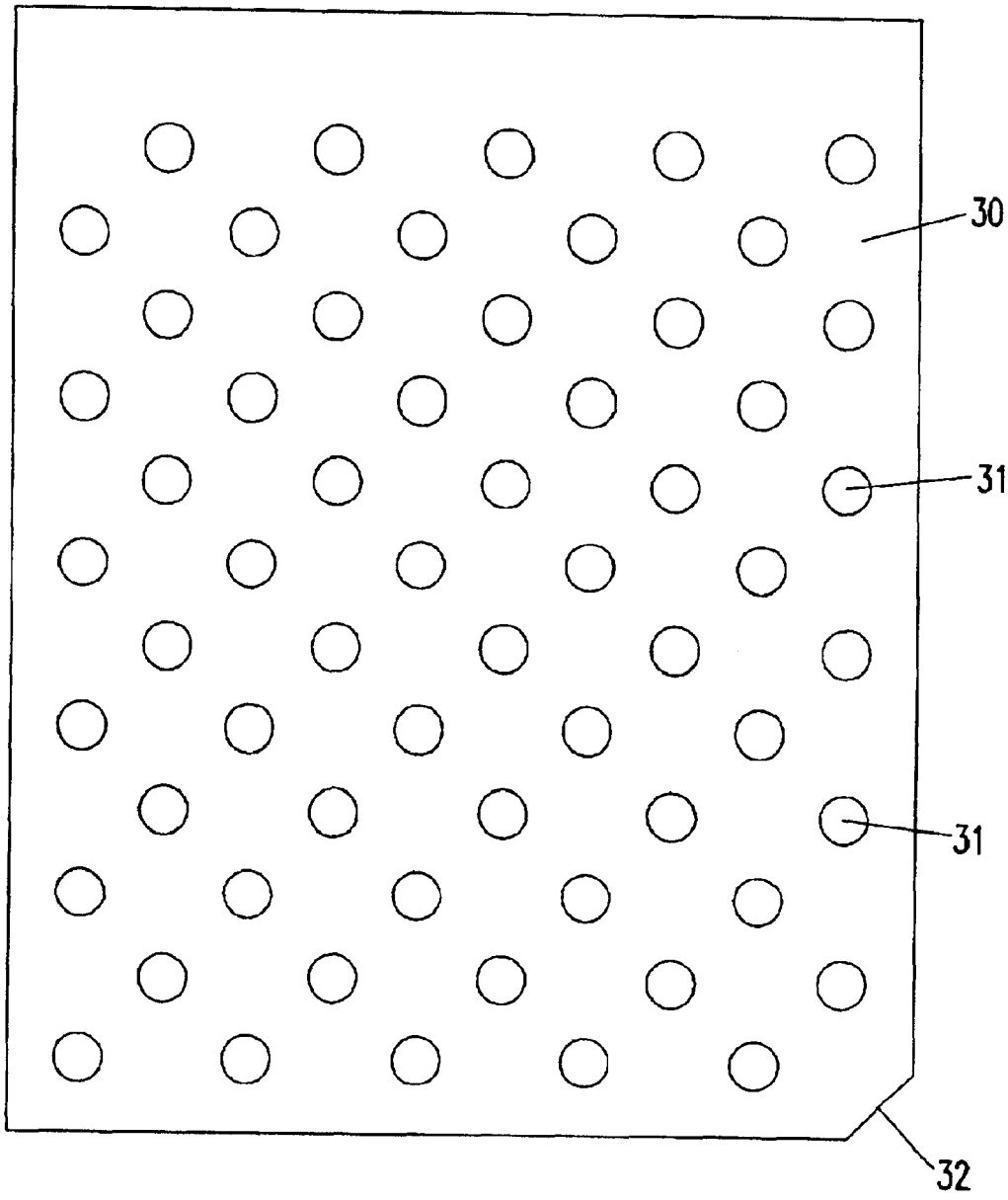
FIG. 6 is a top view of a sizing guide according to the invention.
Figure 7:
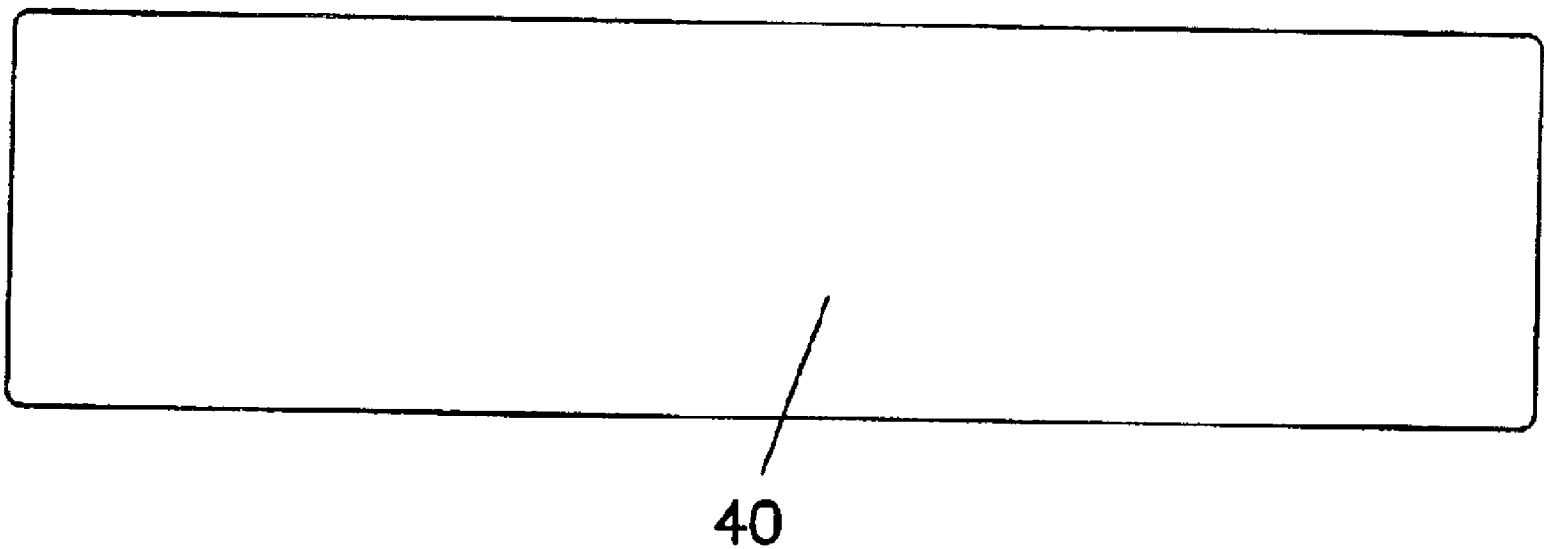
FIG. 7 is a side view of a divider according to the invention.

One embodiment of a removable sizing guide 30 is shown in FIG. 6. The sizing guide 30 has a plurality of apertures 31 that correspond to a particular pill size. The apertures 31 in the sizing guide 30 are in the same pattern as the apertures 21 in the movable plate 20. If the pattern of apertures 31 is not symmetrical and centrally aligned on the guide 30 such that the pattern remains the same regardless of the orientation of the guide 30, a mark on the guide 30 can assist in proper placement of the sizing guide 30 to assure alignment of the apertures 31 with the plate apertures 21. Depending on the type of mark, a corresponding mark can be located on the housing 10 or moveable plate 20. In the embodiment shown in FIG. 6, the sizing guide 30 is marked by a notched corner 32 that corresponds to a marker 15 on the housing (see FIG. 4). When the sizing guide 30 is placed over the movable plate 20 in the housing 10 with the notched corner 32 matched to the marker 15, and the plate 20 is moved into the second position, the apertures 31, 21 are in register.

Sizing guides 30 for various sizes of pills or capsules can be provided with the pill counter. The sizing guide 30 illustrated in FIG. 6 is designed for small pills. A sizing guide 30 with slightly larger apertures 31 would be suitable for medium pills. A sizing guide 30 with apertures 31 the same size as the apertures 21 in the movable plate 20 would be suitable for large pills. The thickness of the sizing guide 30 and the dimensions of the apertures 31 are large enough to retain the pills or capsules to be counted, but small enough to exclude two pills or capsules in each aperture 31. The thickness of a sizing guide 30 will generally be such that multiple pills, sitting one on top of another, cannot fit within the apertures 31. Thus the thickness of a sizing guide 30 for small pills can be thinner than the thickness of a sizing guide 30 for large pills. Similarly, the apertures 31 should have a diameter less than twice the diameter of the pills being counted to prevent two pills fitting within the apertures 31 in side-by-side orientation.

Sizing guides 30 designed for capsules can have a thickness such that the capsules fit on end into the apertures without falling over. This allows a single movable plate 20 to be used for both pills and capsules. For example, the thickness of the capsule sizing guides 30 is at least about half the length of the capsules. The thickness of the capsule sizing guides 30 can be equal to the length of the capsules. Alternatively, a sizing guide 30 for capsules can have apertures 31 sized to allow the capsules to pass through on their sides. The apertures 31 can be circular, oval, or any other shape that accommodates the pills and/or capsules.

The apertures 21, 31 can be arranged in multiples of commonly desired numbers of pills, such as five, ten, etc. For example, in the embodiment shown in FIGS. 5 and 6, the sizing guide 30 and movable plate 20 have apertures 31, 21 in rows of six and columns of five. The slots 16 in the housing 10 are positioned after each row of apertures 31 on the sizing guide 30. To count 30 pills, a divider 40 is inserted into the sixth set of slots 16, as shown in FIG. 2. The slots 16 may be marked with the number 30 for easy reference. This separates six columns of five apertures 31 from the rest of the sizing guide. The divider 40, shown in FIG. 7, can be a thin piece of plastic or other suitable material that fits into the slots 16 in the housing and extends upwards from the sizing guide 30. More than one height of divider can be provided with the housing. A taller divider 40 can be used with thinner sizing guides 30 for counting pills, while a shorter divider 40 can be used with thicker sizing guides 30 for counting capsules. The divider 40 only need be as tall as the side walls 7, 8 of the housing.

The pill and capsule counter shown in FIGS. 2–7 is used as follows. The movable plate 20 is inserted into the housing to the first position. A sizing guide 30 is selected based on the size of pill or capsule to be counted. The sizing guide 30 is inserted into the housing, matching the notched corner 32 of the guide 30 with the marker 15 on the housing 10 such that the guide 30 fits within the housing chamber and is substantially aligned with and vertically displaced from the movable plate 20. A divider 40 is inserted into the slots 16 corresponding to the number of pills or capsules to be counted. The pivoting cover 17 is closed and an excess of pills or capsules to be counted are placed into the upper section 11 between the pivoting cover 17 and the divider 40. The pill counter is tilted, rocked or shaken to distribute the pills or capsules into the apertures 31 in the sizing guide 30. The pivoting cover 17 is opened and the excess pills or capsules are brushed or shaken into the trough 13, leaving the desired number of pills or capsules in the apertures 31. The excess pills or capsules can be returned to the stock bottle by tipping the pill counter such that the excess pills or capsules exit the trough 13 through the opening 14. The pivoting cover 17 is closed and the flange 23 on the movable plate 20 is pressed, causing the plate 20 to move to the second, inserted position. As the plate moves inward, the apertures 21 move into register with the apertures 31 in the sizing guide 30 causing the pills or capsules to drop into the lower section 12 of the housing. The pill counter is tilted to move the pills or capsules into the trough 13*a* for dispensing the counted pills or capsules into a prescription bottle or other vessel.

The pill counter is part of a system or kit including the housing, at least one movable plate, and at least one removable sizing guide. One example of a pill counting system includes a housing, a movable plate, four pill sizing guides (small, medium, large, extra-large), two capsule sizing guides (small-medium, large), a divider for pills, and a divider for capsules.

The housing, movable plate and removable sizing guides can be made of any suitable durable material that is easily cleaned and sterilized, such as plastic, glass, metal, etc. The housing, movable plate and sizing guides can be made of clear plastic for easy visualization of the pills during the counting process.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A counter for pills and capsules comprising:

(a) a housing comprising a first end and a second end and at least one chamber;

(b) a movable plate positioned within the chamber and dividing the chamber into upper and lower sections, the plate movable from a first position to a second position, the plate having a plurality of apertures;

(c) at least one sizing guide, the sizing guide having a plurality of apertures, the sizing guide removably fitting within the chamber and substantially aligned with and vertically displaced from the movable plate; and (d) a wall extending upward from a bottom of the housing between the first and second ends; wherein when the movable plate is in the first position, the moveable plate extends from the first end of the housing but does not reach the second end of the housing, and the moveable plate, the wall, and the housing enclose at least part of the lower section of the chamber; wherein when the moveable plate is in the first position the apertures in the plate and the apertures in the sizing guide are out of register, and when the plate is in the second position, the apertures in the plate and in the sizing guide are in register.

2. The counter of claim 1 further comprising at least one removable divider adapted to fit within the upper section of the chamber to separate a portion of the sizing guide apertures corresponding to the desired number of pills or capsules to be counted.

3. The counter of claim 1 comprising multiple sizing guides, wherein each sizing guide has apertures corresponding to a particular sized pill or capsule.

4. The counter of claim 1 wherein the apertures in the movable plate and sizing guide are arranged in the same pattern.

5. The counter of claim 4 wherein the apertures in both the movable plate and sizing guide are arranged in rows of five.

6. The counter of claim 1 wherein the housing comprises first and second troughs divided by the wall, the first trough open to the lower section of the chamber and the second trough open to the upper section of the chamber when the movable plate and sizing guides are present.

7. A pill and capsule counting system comprising:

(a) a housing comprising a first end and a second end and at least one chamber. the housing adapted to receive a plate dividing the chamber into upper and lower sections;

(b) a plate adapted to be movable from a first position within the chamber to a second position within the chamber, the plate having a plurality of apertures;

(c) a plurality of sizing guides, the sizing guides having a plurality of apertures corresponding to a particular size of pill or capsule, wherein each sizing guide has a single size of apertures, the sizing guides adapted to removably fit within the chamber in substantial alignment with and vertically displaced from the plate; wherein when the plate is in the first position, the apertures in the plate and the apertures in the sizing guide are out of register, and when the plate is in the second position, the apertures in the plate and in the sizing guide are in register; and (d) a dispensing opening and a separate, adjacent stock collection opening, wherein the openings are configured to allow simultaneous dispensing of counted pills or capsules into a vial and returning of excess pills or capsules to a stock container.

8. The pill and capsule counting system of claim 7 further comprising at least one divider removably fitting within the upper section of the chamber to separate a region of the chamber corresponding to a desired number of pills or capsules.

9. The pill and capsule counting system of claim 7 further comprising a wall extending upward from a bottom of the housing between the first and second ends, the wall separating the dispensing opening and stock collection opening; wherein when the plate is in the first position, the plate, the wall, and the housing enclose at least part of the lower section of the chamber.

10. The counter of claim 1 further comprising first and second pathways leading from an interior of the housing to an exterior of the housing, the first and second pathways being located on opposite sides of the wall and including fully enclosed openings, wherein the first pathway receives excess pills or capsules and the second pathway receives counted pills or capsules for dispensing.

11. A counter for pills and capsules comprising:

(a) a housing having a stock collection region and a dispensing region;

(b) a sorter positioned in the housing such that it divides the housing into upper and lower sections, the sorter having first and second plates with apertures, wherein the first and second plates are vertically displaced from each other and substantially aligned, wherein at least one of the plates is moveable from a first position in which the apertures of the first and second plates are out of register, to a second position in which the apertures of the plates are in register;

(c) a dispensing opening in the dispensing region of the housing;

(d) a collection opening in the stock collection region of the housing, wherein the dispensing and stock collection regions are in the lower section of the housing and are separated by a wall.

12. The counter of claim 11 further comprising a barrier pivotally attached to the housing to separate the collection region from the upper section of the housing.

13. The counter of claim 11 comprising multiple first plates, each first plate having apertures corresponding to a different particular sized pill or capsule.

14. The counter of claim 11 further comprising at least one removable divider adapted to fit within the upper section of the chamber to separate a portion of the plate apertures corresponding to the desired number of pills or capsules to be counted.

* * * * *